US007419439B1

(12) United States Patent
Aleamoni

(10) Patent No.: US 7,419,439 B1
(45) Date of Patent: Sep. 2, 2008

(54) GOLF PUTTER

(76) Inventor: Aran S. Aleamoni, 7808 E. Sabino Hollow Ct., Tucson, AZ (US) 85750

( * ) Notice: Subject to any disclaimer, the term of this patent is extended or adjusted under 35 U.S.C. 154(b) by 26 days.

(21) Appl. No.: 11/132,620

(22) Filed: May 19, 2005

Related U.S. Application Data

(60) Provisional application No. 60/572,395, filed on May 19, 2004.

(51) Int. Cl.
*A63B 69/36* (2006.01)
*A63B 53/04* (2006.01)

(52) U.S. Cl. ..... 473/251; 473/255; 473/313; 473/340; 473/328

(58) Field of Classification Search ..... 473/231–256, 473/313–314, 340–341, 293, 328
See application file for complete search history.

(56) References Cited

U.S. PATENT DOCUMENTS

| | | | | | |
|---|---|---|---|---|---|
| 1,930,477 | A | * | 10/1933 | Hosier | 473/293 |
| D179,002 | S | * | 10/1956 | Hoffmeister | D21/744 |
| D204,001 | S | * | 3/1966 | Lubin | D21/739 |
| 3,408,074 | A | * | 10/1968 | Antonious | 473/249 |
| 3,430,963 | A | * | 3/1969 | Wozniak et al. | 473/251 |
| 3,519,271 | A | * | 7/1970 | Smith | 473/314 |
| 3,637,218 | A | * | 1/1972 | Carlino | 473/325 |
| 3,888,484 | A | * | 6/1975 | Zitko | 473/252 |
| 3,908,996 | A | * | 9/1975 | Molinaro | 473/412 |
| 3,955,819 | A | * | 5/1976 | Yokich | 473/252 |
| 3,980,301 | A | * | 9/1976 | Smith | 473/314 |
| 4,138,117 | A | * | 2/1979 | Dalton | 473/255 |
| 4,314,701 | A | * | 2/1982 | Swanson | 473/249 |
| 4,324,404 | A | * | 4/1982 | Dian | 473/340 |
| 4,697,813 | A | * | 10/1987 | Inoue | 473/305 |
| D311,049 | S | * | 10/1990 | Sanchez | D21/745 |
| 4,964,639 | A | * | 10/1990 | Tucker | 473/255 |
| 5,072,941 | A | * | 12/1991 | Klein | 473/255 |
| 5,470,070 | A | * | 11/1995 | Bendo | 473/252 |
| 5,685,784 | A | * | 11/1997 | Butler | 473/340 |
| 5,816,931 | A | * | 10/1998 | Schooler | 473/248 |
| 6,299,546 | B1 | * | 10/2001 | Wang | 473/314 |
| 6,406,380 | B1 | * | 6/2002 | Jackson | 473/340 |
| 6,688,990 | B2 | * | 2/2004 | Sanchez | 473/340 |
| 2004/0266542 | A1 | * | 12/2004 | Goldsmith | 473/238 |

FOREIGN PATENT DOCUMENTS

| | | |
|---|---|---|
| GB | 2 278 063 | * 11/1994 |

* cited by examiner

*Primary Examiner*—Sebastiano Passaniti
(74) *Attorney, Agent, or Firm*—Lawrence R. Oremland, P.C.

(57) ABSTRACT

A golf putter with a new and useful head configuration is provided. The putter head is designed to facilitate a golfer's ability to effectively contact and project a golf ball along a desired path on a putting surface. The head is designed to enable a golfer to effectively align the putter head with a golf ball as the golf ball is addressed, and easily and effectively swing the putter, to propel the golf ball along a desired path on the putting surface.

13 Claims, 9 Drawing Sheets

GOLF PUTTER

RELATED APPLICATION/CLAIM OF PRIORITY

This application is related to and claims priority from provisional application Ser. No. 60/572,395, filed May 19, 2004, and entitled Golf Putter, which provisional application is incorporated by reference herein.

BACKGROUND

The present invention relates to a new and useful golf putter, and particularly to a new and useful head for the golf putter.

In applicant's experience, a golf putter should be constructed in a manner that facilitates a golfer's ability to effectively contact and project a golf ball along a desired path on a putting surface. Preferably, this entails effectively aligning the putter head with a golf ball as the golf ball is addressed, and easily and effectively swinging the putter, to propel the golf ball along a desired path on the putting surface.

SUMMARY OF THE INVENTION

The present invention provides a golf putter with a new and useful head configuration that is designed to facilitate a golfer's ability to effectively contact and project a golf ball along a desired path on a putting surface. Preferably, this entails effectively aligning the putter head with a golf ball as the golf ball is addressed, and easily and effectively swinging the putter, to propel the golf ball along a desired path on the putting surface.

A golf putter according to one embodiment of the present invention comprises a longitudinally extending head with a longitudinal portion and a connection for a shaft (preferably a hosel) connected with the longitudinal portion of the head. The head has a ball-striking surface at one end, and the head is further configured to provide the putter with structural stability and to enable the head to conveniently swing in an arc along a putting surface to enable the striking surface to strike a golf ball, and the connection (e.g. the hosel) is configured for connection with a golf club shaft.

A golf putter according to a preferred embodiment of the present invention has a central opening of a predetermined configuration in the longitudinal portion, and the central opening is configured in a manner that produces a predetermined weight balance in the putter, and enables the putter to be addressed to a golf ball with the striking surface addressed directly to the golf ball.

In addition, in a preferred embodiment, the head has a front taper toward the striking surface and a rear taper toward the opposite end of the head, to minimize interference between the head and a putting surface as the head swings in an arc along the putting surface.

Still further, according to a preferred embodiment, the head further includes a top surface with a longitudinally extending mark that is visible to a player addressing a golf ball with the putter, so that the longitudinally extending mark provides the player with an alignment tool for swinging the putter.

Other features of the present invention will become further apparent from the following detailed description and the accompanying drawings.

BRIEF DESCRIPTION OF THE DRAWINGS AND EXHIBIT

Figure 8:
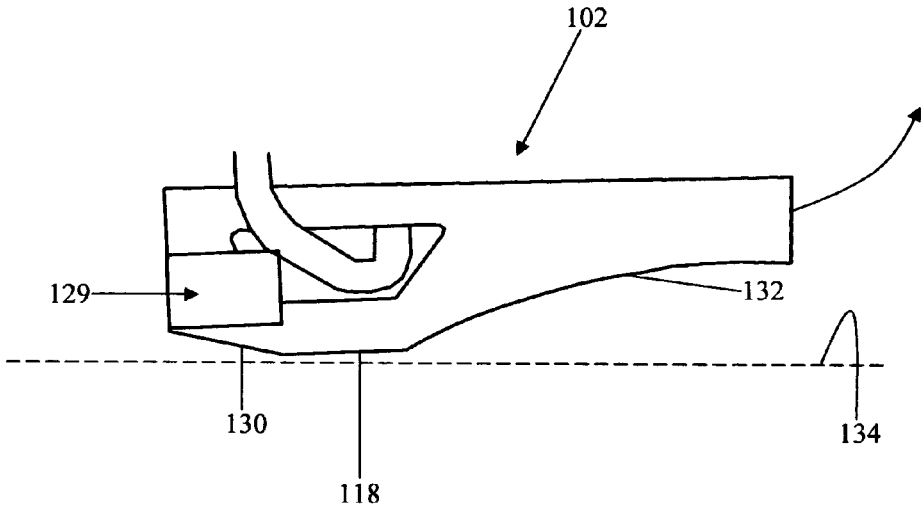
Figure 9:
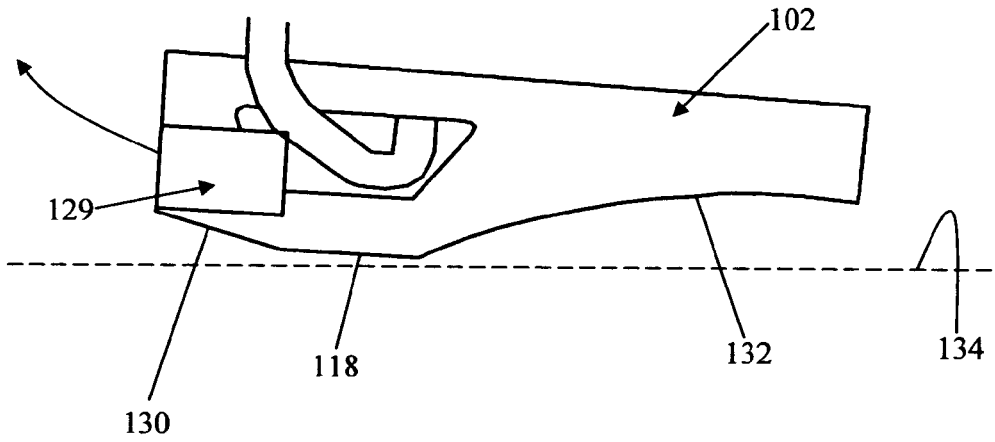

FIG. 8 schematically illustrates a golf putter head according to the present invention, during a back swing; and FIG. 9 schematically illustrates a golf putter head according to the principles of the present invention, during a follow through.

DETAILED DESCRIPTION

As discussed above, the present invention relates to a new and useful golf putter and particularly to a new and useful head for the golf putter. The principles of the present invention are described below in connection with a preferred configuration for a golf putter head, and it will be clear to those in the art how the principles of the present invention can be used to produce various forms of golf putter heads. For example, the principles are described below in connection with a golf putter designed for a right handed golfer, but it will be clear how those principles can be used to produce a golf putter for a left handed golfer. Moreover, the principles of the invention are described below in connection with a preferred form of golf putter, which uses a hosel to connect the putter head with a golf putter shaft. However, it will be clear to those in the art that the principles of the present invention may also be able be to be used with other devices that may be developed for connecting a golf putter shaft with a putter head.

Figure 1:
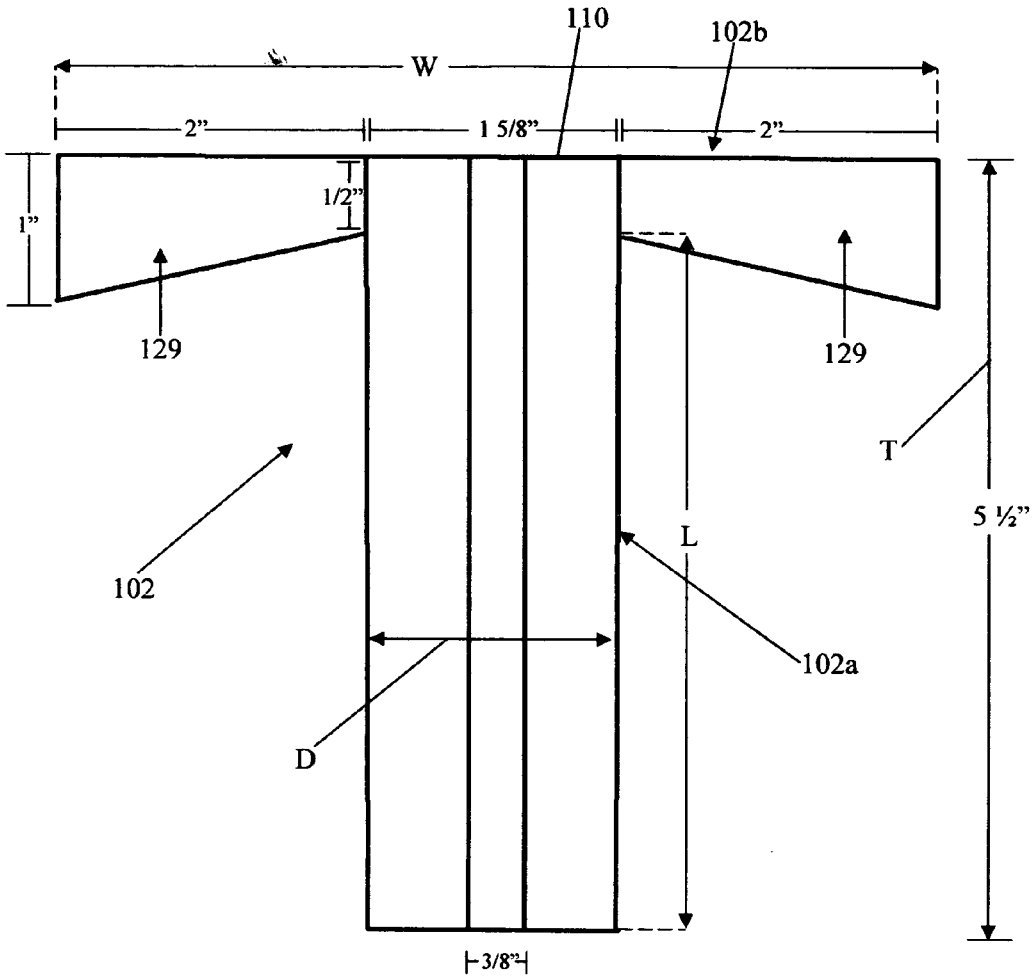
FIG. 1 is a schematic top view of a golf putter head constructed according to the present invention, with certain preferred dimensions shown thereon.
Figure 2:
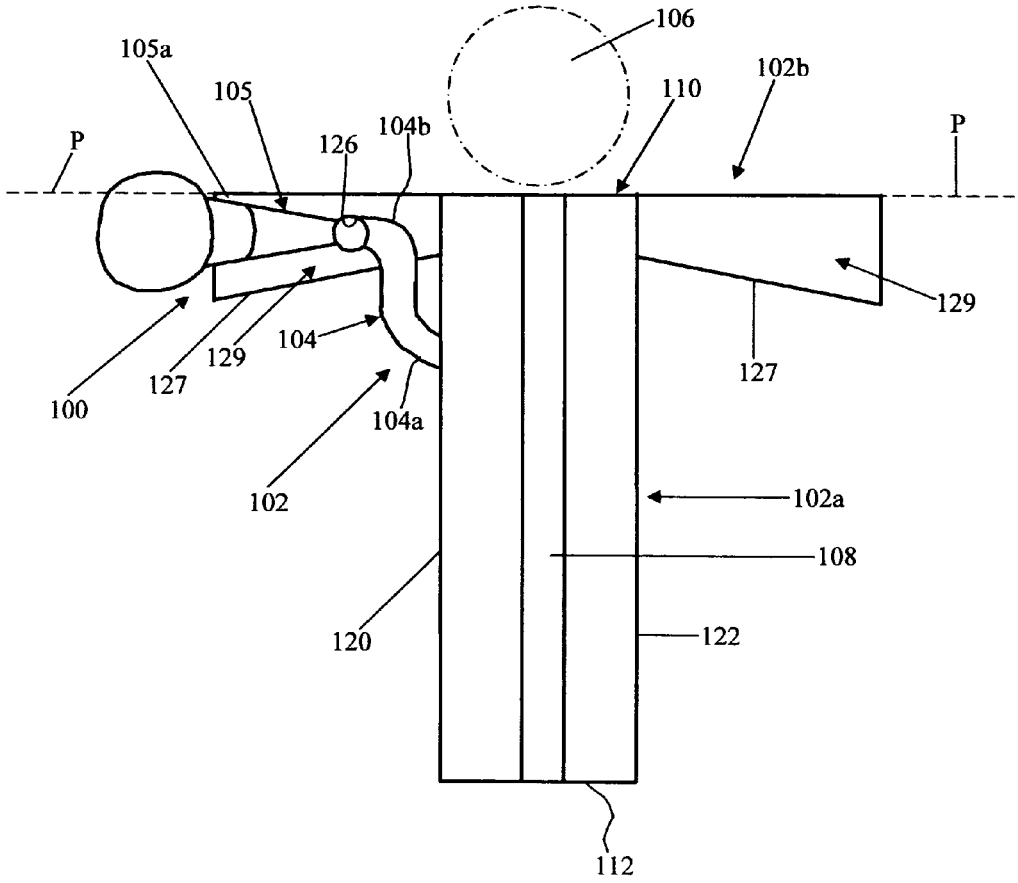
FIG. 2 is a schematic top view of a golf putter head and hosel, according to the principals of the present invention.

FIG. 2 schematically illustrates a golf putter 100 constructed according to the principles of the present invention. The putter 100 includes a head 102, and a hosel 104 connected with the head, in a manner described further below. A shaft 105 is schematically illustrated in FIG. 1, and is connected with the head 102 in a manner described further below.

As seen in FIG. 2, the golf putter 100 is shown with the head 102 addressed with a golf ball 106 (shown in phantom). A marking 108 that is provided on the head 102 enables the head to be effectively aligned with the golf ball 106. When the putter is swung, the head 102 is moved in an arc away from and then toward the golf ball, to propel the golf ball along a putting surface. In addition, the head has an arrow like configuration, as described further below, which is helpful to a golfer in lining up the putter with a golf ball.

Figure 3:
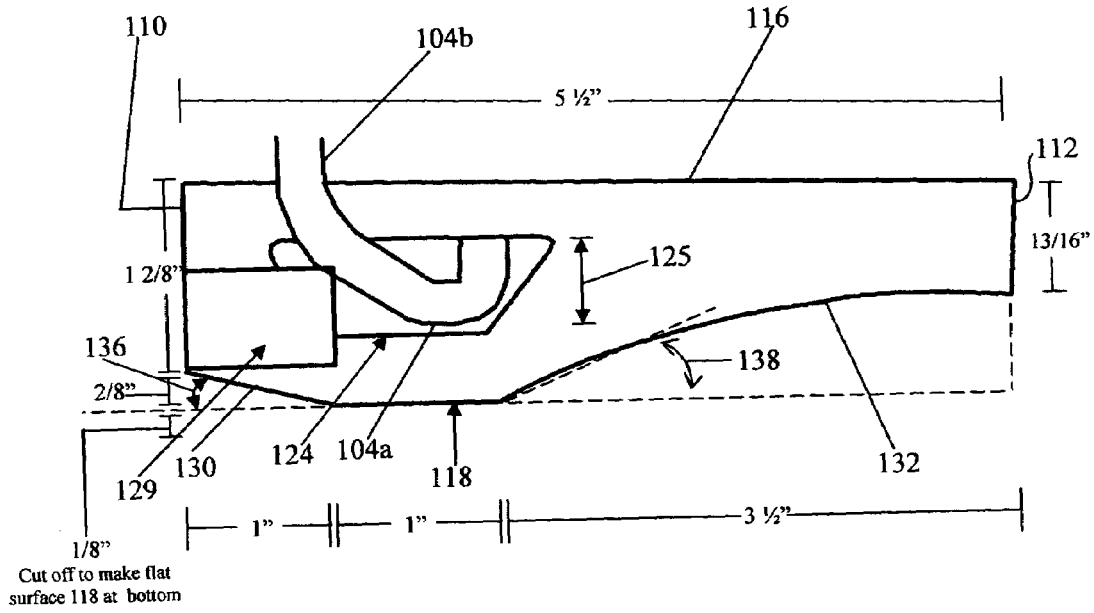
FIG. 3 is a right side view of the golf putter head and hosel of FIG. 2, with certain preferred dimensions shown thereon.
Figure 7:
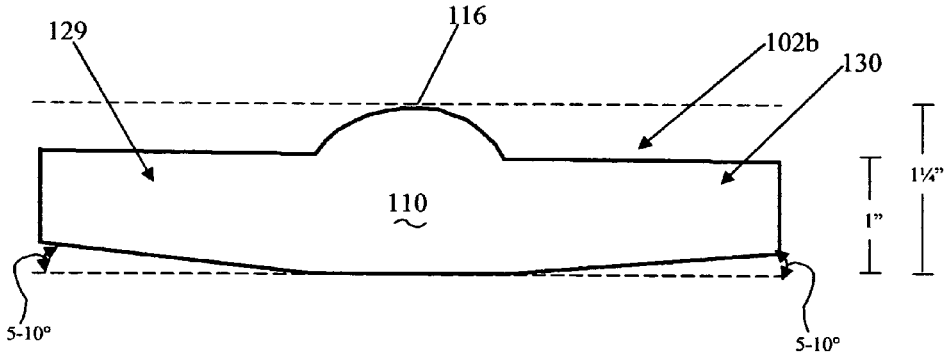
FIG. 7 is a schematic view of the front surface of the golf putter head of FIG. 1, with certain preferred dimensions shown thereon.

The head 102 extends from a ball-striking front surface 110 to a rear surface 112, and includes a longitudinal portion 102*a*. In this application reference to a "longitudinal portion" of the head means a portion of the head that is longer (in the direction L, see FIG. 1) than its largest cross sectional dimension (e.g. the cross sectional dimension D of the thickest portion of the section 102*a*). The front of the head may include a transverse portion 102*b* that includes a pair of wings 129 that extend transverse to the longitudinal portion 102*a* (i.e. the wings 129 extend in directions generally perpendicular to the longitudinal extent of the longitudinal portion). The transverse portion 102*b* includes the ball striking front surface 110. The ball striking front surface includes the wings 129, to provide the front surface with "light touch" (or "soft touch") putting capability, e.g. when executing steep downhill putts. Moreover, the width W of the transverse portion 102*b* and the length L of the longitudinally extending portion 102*a* are such that the width W is greater than the overall length T of the head (from the front striking surface 110 to the rear surface 112). Also, as seen from FIGS. 3 and 7, the bottom of the transverse portion 102*b* may taper as it extends outward from the striking surface, and as seen from FIGS. 1 and 2, the wings 129 have rear surfaces 127 that may also taper toward the longitudinal portion 102*a*. Thus, the wings 129 provide the head with structural stability by distributing more weight to the perimeter, and also provide the head with a visual effect somewhat like an arrow, which helps a putter visually line up the putter with a golf ball. When the head is addressed to the golf ball 106, the front ball-striking surface 110 is adjacent to the golf ball. As the head is swung in an arc, the head is swung away from the ball, and then toward and through the golf ball to strike the golf ball and propel the golf ball along a putting surface.

The longitudinal portion 102*a* of the head 102 is generally based on a cylindrical profile, in the sense that parts of its outer surface other than the specially formed tapered portions 130, 132 described below (and possibly the bottom surface 118) are generally rounded and are based on a cylindrical profile. The longitudinal portion 102*a* of the head has a top surface portion 116, a bottom surface portion 118 and side surface portions 120, 122. The longitudinal portion 102*a* of the head 102 also has specially configured longitudinally extending central opening 124. The central opening 124 is longitudinally extending in the sense that its length (between the front and rear surfaces 110, 112 is greater than its height 125. Moreover, the central opening 124 extends below the top surface portion 116, above the bottom surface portion 118, and preferably extends from one side 120 to the other side 122 of the head. Thus, access to the central opening 124 is possible through either side of the head. The cylindrical shape and size of the longitudinal portion 102*a* is designed to be a visual continuation of the golf ball, as described further below.

Figure 5:
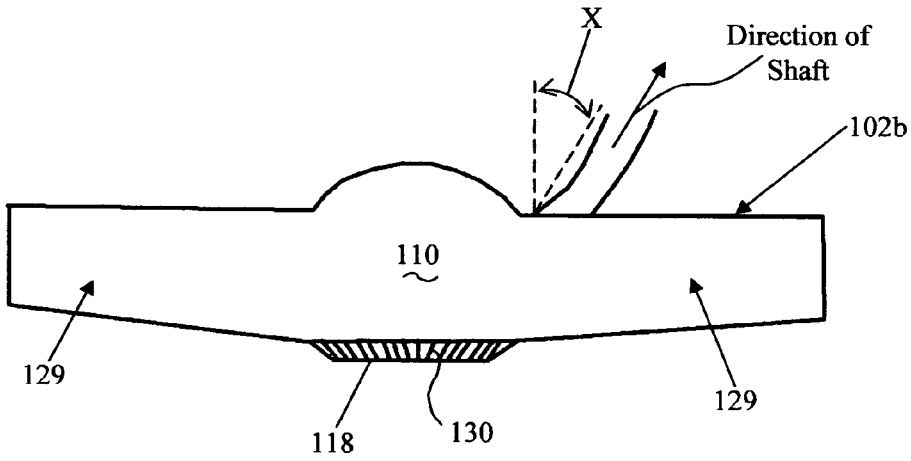
FIG. 5 is a front view of the golf putter head and hosel of FIG. 2.
Figure 6:
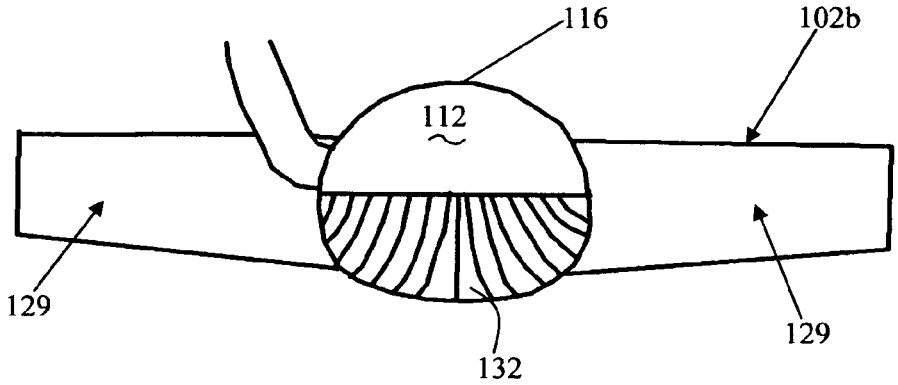
FIG. 6 is a rear view of the golf putter head and hosel of FIG. 2.

The hosel 104 preferably extends out of the opening 124 and to one side of the head (i.e. the side to which the shaft 105 connects). The hosel 104 may also have a portion 104*a* that extends forward relative to the head and a portion 104*b* that extends upward from portion 104*a*. The upward extending portion is at least partially hollow, with an opening 126 configured to receive the lower end of a putter shaft 105. In FIG. 2, the lower end of shaft 105 is configured to fit into the opening in the hosel portion 104*b*. Preferably, the shaft 105 and the hosel 104 are configured so that the shaft extends about one quarter to one half inch into the hosel and is adhesively bonded to the hosel (e.g. by an epoxy resin). Also, as schematically illustrated in FIG. 5, the shape and configuration of the hosel and shaft, when viewed from the front of the putter, are preferably designed so that the shaft extends upward relative to the head at a predetermined angle X relative to a vertical tangent to the cylindrical longitudinal portion 102*a* of the head. The angle X is currently preferred to be at least 10 degrees, but may be varied in accordance with the specifications that may govern the design of golf putters by golfing organizations.

Figure 4:
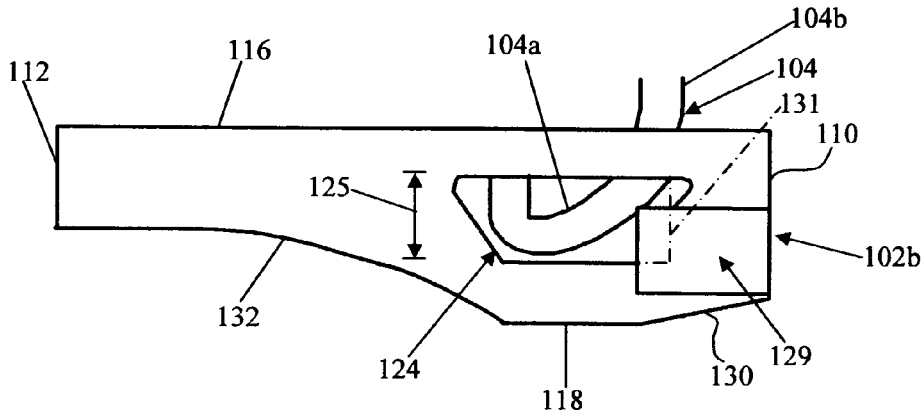
FIG. 4 is a left side view of the golf putter head and hosel of FIG. 2.

The putter, and particularly the configuration of the central opening 124, is configured so that the head 102 has a predetermined weight balance. Specifically, according to a preferred embodiment, the central opening 124 extends from one side 120 of the head to the other side 122 of the head, and the hosel 104 is disposed at least partially in the central opening 124 and extends out of the central opening. The central opening 124 reduces the weight of the head, and may have the inverted trapezoidal configuration shown in FIGS. 3 and 4, in side view, with a wide end closer to the top portion 116 of the head, to lower the center of gravity of the head. Thus, the head is configured to reduce the weight of the head and to lower the center of gravity of the head. Moreover, while the central opening 124 shown in FIGS. 3 and 4 has an inverted trapezoidal shape, the shape of the central opening can also be a bit more complex, while maintaining the foregoing objective. For example, one side of the central opening can have the shape shown in phantom at 131 in FIG. 4.

In addition, the head 102 is preferably formed of aluminum, which can be cast or otherwise formed into the configuration described herein. The hosel 104 can be formed in one piece with the head, or can be formed separately and secured to the head (e.g. by welding, by adhesive, or other means). It is also contemplated that the head, or parts of the head, can be formed of other materials, e.g. other metals or composite materials.

Furthermore, according to the preferred embodiment, the golf shaft 105 is connected with the head (e.g. through the hosel 104) in a manner that enables at least a part of the grip 105*a* on the shaft to extend at least partially over the plane P of the front striking surface 110 as the front striking surface 110 is addressed to a golf ball. This relationship is shown in FIG. 2. It is also contemplated that the front end of the head could have a recess (not shown) that is filled with a synthetic material that has a front surface that is located in the plane P and forms part (or all) of the front striking surface 110

Another aspect of a preferred configuration for the putter head, according to the principles of the invention, is the way the head is configured to provide a significant front striking surface 110, and also provide a configuration that allows the putter head to be swung along a smooth arc along a putting surface, without interference from the putting surface, either on the back swing, contact or the follow through. Specifically, the head has a front tapering surface 130 that extends from the bottom surface 118 to the front striking surface 110, and a rear-tapering surface 132 that may be slightly curved (FIGS. 3, 4) and extends from the bottom surface 118 to the rear surface 112 of the head. As seen from FIGS. 3 and 4, the front tapering surface 130 preferably extends at an angle 136 of about 5 to 15 degrees to the bottom surface 118, and the rear tapering surface 132 extends at an angle 138 of about 25 to 45 degrees to the bottom surface 118. Thus, the front tapering surface 130 is shallower (i.e. less tapered) than the rear tapering surface 132, which results in maximizing the area of the front striking surface 110, while minimizing interference between the head and a putting surface as the head swings in an arc along the putting surface. In addition, the front tapering surface 130 is shorter (lengthwise) than the rear tapering surface 132. Thus, as seen from FIG. 8, during a back swing, the front tapering surface 130 allows the head to be swung in an arc without interference from the putting surface 134. Moreover, as seen from FIG. 9, as the head is swung forward in an arc and strikes the golf ball, the rear tapering surface 132 enables the head to follow through along the arc without interference from the putting surface 134. Still further, it may also be desirable to flatten the bottom surface 118, to further enable the putter to swing smoothly along a putting surface, and to allow for a more solid setup when a golf ball is addressed. If the bottom surface 118 is intended to be flattened, the longitudinal portion 102*a* of the head is still based on a cylindrical profile, e.g. a 1⅝ diameter profile, as discussed below, and about ⅛" of that profile is cut off to produce the flattened bottom surface 118.

Still another preferred aspect of a golf putter head, according to the present invention, is the provision of the longitudinally extending mark 108 that extends along the top surface (FIG. 1). As discussed above, the cylindrical shape and size of the longitudinal portion 102*a* of the head is designed to be a visual continuation of the golf ball and thereby provides a good visual aid to a player addressing a golf ball with the putter. The arrow like shape of the head also contributes to the visual aid provided by the head to a player addressing a golf ball. The mark 108 provides a still further visual aid to a golfer addressing a golf ball. The mark 108 can extend along a portion of the top surface, or it can extend completely along the top surface. Moreover, the mark 108 can be applied to the top surface or to a longitudinal groove or trough formed in the top surface. The mark 108 is applied to the top surface in a color that provides a good visual contrast to the surrounding environment (e.g. the putting surface), so that the mark 108 provides a good additional visual aid to a player addressing a golf ball with the putter, helping the player address and strike the golf ball in a desired manner.

Currently, the preferred dimensions of the head 102 are as follows: The width W of the front portion 102*b* of the head is about 5⅝ inches. The longitudinal length T of the head (i.e. from the front striking surface 110 to the rear surface 112) is currently about 5.5 inches. The "diameter" of the longitudinal portion 102*a* of the head (i.e. the diameter of the cylindrical profile upon which the longitudinal portion of the head is based is currently about 1⅝ inches. Other preferred dimensions are shown on certain Figures. It is contemplated that these dimensions may be varied, but their proportionate relationship to each other would preferably be in the general range of the preferred dimensions. In addition, it is contemplated that to provide a good overall weight balance in the putter, it may be desirable to extend the hosel 104 so that it is close to the front striking surface 110 of the head.

Accordingly, as seen from the foregoing description, the present invention provides a golf putter with a head that has a longitudinal portion of the type described above, a predetermined weight balance, a striking surface at one end of the head, and is configured to enable a golfer to conveniently address a golf ball, and to swing the putter head along an arc to strike the golf ball, without interference from the putting surface. With the foregoing disclosure in mind, it is believed that various adaptations of a golf putter, according to the principles of the present invention, will be apparent to those in the art.

The invention claimed is:

1. A golf putter comprising a head and a hosel connected with the head; the head having a longitudinal central portion that is based on a predetermined cross sectional profile corresponding to the shape of a golf ball; the head having a ball striking surface at one end, and the head being further configured to enable the head to conveniently swing in an arc along a putting surface to enable the striking surface to strike a golf ball, and the hosel extending away from the side of the longitudinal central portion and configured for connection with a golf club shaft, wherein the longitudinal portion of the head is based on a generally cylindrical profile, the central opening extends from one side of the head to the other side of the head, wherein the hosel is disposed at least partially in the central opening and extends out of the central opening and away from the side of the longitudinal central portion, the hosel being connected with the golf club shaft in a manner such that the shaft extends at a predetermined angle to a vertical tangent to the head, and the configuration of the central opening and the hosel is designed to produce a predetermined weight balance in the putter.

2. A golf putter as defined in claim 1, wherein the central opening is configured to reduce the weight of the head and to lower the center of gravity of the head.

3. A golf putter as defined in claim 1, wherein the central opening has a wide end closer to the top of the head, to lower the center of gravity of the head.

4. A golf putter comprising a head and a hosel connected with the head; the head having a longitudinal central portion that is based on a predetermined cross sectional profile corresponding to the shape of a golf ball; the head having a ball striking surface at one end, and the head being further configured to enable the head to conveniently swing in an arc along a putting surface to enable the striking surface to strike a golf ball, and the hosel extending away from the side of the longitudinal central portion and configured for connection with a golf club shaft, wherein the longitudinal central portion includes a rear end of the head, and the head having a bottom surface, a front tapering surface that tapers toward the striking surface and a rear tapering surface that tapers toward the rear end of the head, to minimize interference between the head and a putting surface as the head swings in an arc along the putting surface.

5. A golf putter as defined in claim 4, wherein the head further includes a top surface with a longitudinally extending mark that is visible to a player addressing a golf ball with the putter, so that the longitudinally extending mark provides the player with a visual aid for addressing a golf ball.

6. A golf putter as defined in claim 4, wherein the front tapering surface is shallower than the rear tapering surface, to produce a relatively large amount of the front end as a striking surface.

7. A golf putter as defined in claim 6, wherein the front tapering surface has a taper that is from about 5 to 10 degrees to the bottom surface and the rear tapering surface has a taper that is about 18 degrees to the bottom surface.

8. A golf putter as defined in claim 6, wherein the front of the head has a pair of wings that extend transverse to the longitudinal portion and provide the head with an arrow appearance that provides a further visual aid to a player addressing a golf ball.

9. A golf putter as defined in claim 4, wherein the golf shaft is connected with the head in a manner that enables at least a part of the grip on the shaft to extend at least partially over the plane of the striking surface as the striking surface is addressed to a golf ball.

10. A golf putter comprising a head and a hosel connected with the head; the head having a longitudinal central portion that is based on a predetermined cross sectional profile corresponding to the shape of a golf ball; the head having a ball striking surface at one end, and the head being further configured to enable the head to conveniently swing in an arc along a putting surface to enable the striking surface to strike a golf ball, and the hosel extending away from the side of the longitudinal central portion and configured for connection with a golf club shaft, wherein the longitudinal central portion of the head is based on a generally cylindrical profile that corresponds substantially to the circular configuration of a golf ball, the hosel extends away from the longitudinal central portion and to one side of the longitudinal central portion, the hosel is configured for connection with the golf club shaft in a manner such that the shaft extends at a predetermined angle to a vertical tangent to the head, and produces a predetermined weight balance in the putter.

11. A golf putter as defined in claim 10, wherein the longitudinal central portion has a width that is substantially the same as the width of a golf ball.

12. A golf putter comprising a head and a hosel connected with the head; the head having a longitudinal central portion that is based on a predetermined cross sectional profile corresponding to the shape of a golf ball; the head having a ball striking surface at one end, and the head being further configured to enable the head to conveniently swing in an arc along a putting surface to enable the striking surface to strike a golf ball, and the hosel extending away from the side of the longitudinal central portion and configured for connection with a golf club shaft, wherein top of the longitudinal central portion has a sight line thereon, and the front of the head has a pair of wings that extend transverse to the longitudinal central portion and the sight line, and wherein the wings have rear surfaces that begin outward of the longitudinal central portion and taper inward toward the longitudinal central portion and the sight line and forward toward the front of the putter, so that the front of the putter, the wings and the sight line provide the head with an arrow appearance that provides a visual aid to a player addressing a golf ball and swinging the putter in relation to the golf ball.

13. A golf putter as defined in claim 12, wherein the longitudinal central portion of the head has a central opening of a predetermined configuration, the hosel extending away from the central opening and the side of the longitudinal central portion, and the golf club shaft is configured for connection with the hosel in a manner that produces a predetermined weight balance in the putter, and enables a golf ball to be addressed by the putter with the striking surface aligned with the golf ball.

* * * * *